United States Patent [19]

Hallberg

[11] Patent Number: 4,904,121

[45] **Date of Patent: * Feb. 27, 1990**

[54] DEVICE FOR STABILIZING BULK MATERIAL

[75] Inventor: Carl R. Hallberg, Kongsberg, Norway

[73] Assignee: A/S Platon, Notodden, Norway

[ * ] Notice: The portion of the term of this patent subsequent to Jan. 17, 2006 has been disclaimed.

[21] Appl. No.: 288,449

[22] Filed: Dec. 22, 1988

Related U.S. Application Data

[63] Continuation-in-part of Ser. No. 48,821, May 12, 1987, Pat. No. 4,798,498, which is a continuation-in-part of Ser. No. 13,786, Feb. 12, 1987, abandoned.

[30] Foreign Application Priority Data

Feb. 24, 1986 [NO] Norway ..... 860684
Feb. 24, 1987 [NO] Norway ..... 870764

[51] Int. Cl.[4] ..... E02D 17/20; E02B 3/12

[52] U.S. Cl. ..... 405/258; 135/117; 256/12.5; 405/16; 405/19

[58] Field of Search ..... 405/15, 16, 32, 258, 405/19, 284; 52/74; 135/87, 117; 160/45, 76; 256/12.5

[56] References Cited

U.S. PATENT DOCUMENTS

| | | | |
|---|---|---|---|
| 1,905,176 | 4/1933 | Kieckhefer | 405/15 X |
| 2,777,454 | 1/1957 | Kramer | 135/87 |
| 2,902,730 | 9/1959 | Meagher | 52/74 |
| 2,960,797 | 11/1960 | Frehner | 405/284 X |
| 3,426,536 | 2/1969 | Danz | 405/32 |
| 4,530,622 | 7/1985 | Mercer | 405/258 |
| 4,798,498 | 1/1989 | Hallberg | 405/258 |

FOREIGN PATENT DOCUMENTS

| | | |
|---|---|---|
| 1161618 | 2/1984 | Canada . |
| 16730 | 2/1981 | Japan . |

*Primary Examiner*—David H. Corbin
*Attorney, Agent, or Firm*—Barnes & Thornburg

[57] ABSTRACT

The invention relates to a device, especially for stabilizing soil material and other moldable compositions such as uncured concrete or the like, comprising a substantially elongated web sheet mounted on a support which forms a plurality of cells or pockets which can be manufactured from inexpensive raw material, which possibly can easily decompose, and requires a minimum transport volume. The device provides favorable anchoring in the ground which is to be soil stabilized and forms pockets or cells having walls extending vertically independent of the slope angle of the ground for stabilizing the soil even during heavy rain. The web is constituted by an initially relatively thin, substantially flat web sheet, preferably of flexible plastic, which in a first direction is provided with rows of consecutively arranged slits which are so staggered relative to each other that the web by the stretching thereof in a second direction forms oppositely undulating strips which upon mounting of the web on a more or less inclined hill, define side by side arranged cells or pockets which can be filled with soil or other material being stabilized by the device. Due to the lower edges of the undulating strips, the device in stretched condition may easily be pressed down into the ground for anchoring in the ground and the various degrees of stretching can be harmonized to the various angles of inclination of the ground.

18 Claims, 4 Drawing Sheets

11
12b
12
12a 1
2
2a
2b
11
p
1
3a
5
6
8
III
3b
6
3c
7
4
9

13
III
13
9
4
3

10

DEVICE FOR STABILIZING BULK MATERIAL

BACKGROUND OF THE INVENTION

This is a Continuation-in-Part application of my commonly owned U.S. application Ser. No. 048,821, filed May 12, 1987, and now U.S. Pat. No. 4,798,498, which in turn is a Continuation-in-Part of my commonly owned U.S. application Ser. No. 013,786, filed on Feb. 12, 1987, now abandoned, and based on Norwegian Patent . Application No. 86.0684, filed in Norway Feb. 24, 1986.

The present invention relates to a device, generally for stabilizing bulk material and more specifically for stabilizing soil masses and moulding compositions such as uncured cement and the like. The device comprises a substantially elongated web which in mounted position defines a plurality of cells or pockets.

The invention also relates to a method for stabilizing bulk material, especially soil masses and moulding composition such as uncured cement and the like.

The invention also relates to a special use of such a device.

In connection with stabilizing soil masses and especially slopes, various products have been previously known. For example, there may be used a net which is made from plastic or steel wire. These types of nets will function satisfactorily, provided the slope is not too steeply inclined and provided the soil masses are not influenced by heavy rain before the planting of bushes or the like.

Another type of device for stabilizing soil comprises plastic sheets which are stretched in both directions after first having been provided with holes. Examples of such plates are known from Norwegian Patent Specifications 134995, 152611 and 152612. It is true that the stretching of the sheets or the webs results in a net configuration which has a larger depth or thickness than usual flat wire netting, but they do not provide an earth stabilizing effect in the form of stage-wise arranged pockets.

Another product is disclosed in Finnish Patent Application 84109042.6 and Norwegian Patent Application 843270, and comprises multi-edged cells which together define an element. These elements can be interconnected to cover a slope, the elements having a certain height, for example 90 mm , a fact which makes it possible for the elements to hold a substantial amount of soil also in sloped terrain. However, the production of such elements involves not only a larger quantity of plastic material but also a more costly production. Besides, the elements require a large volume during transport, a fact which involves higher transport expenses even if the elements to a certain degree can be stacked on top of each other.

Further, there are known so-called semi-stiff, three-dimensional geotextiles of honeycomb type made from non-woven polyester for stabilizing the top layer of road embankments, riverbanks and the like. This type of stabilizing device can be transported in collapsed form and is easy to put into position at the place of use. However, the production of such geotextiles is very sophisticated and costly, the product itself being too soft for rendering a sufficient anchoring effect in the ground onto which it is to be mounted. Besides, the walls of the cell structure of the finished mounted geotextile will extend at a right angle from the plane of the ground when used on an inclined slope and the soil which has been filled into the cells and is to be stabilized, more easily will flow out of the cells or pockets due to heavy rain showers.

An object of the present invention is first of all to give instruction for a device for stabilizing soil masses and molding compositions such as uncured cement or the like and then to provide a device which does not suffer from the disadvantages inherent in the prior art devices, the favorable characteristics thereof being preferably retained.

In other words, according to the invention a stabilizing device is desired which conforms to the following requirements:

1. It is to be manufactured from relatively inexpensive raw material.
2. The speed of disintegration should be varied, from for example easily decomposable in connection with soil areas which are easily overgrown, to a disintegration which takes place over several years.
3. The process of manufacture should be simple and preferably based on prior art.
4. The device should require a small transport volume and the mounting on the site should be simple.
5. The device should have an inherent good faculty of anchoring.
6. The cells or the pockets which are formed during mounting should have walls which possibly can be regulated, and which preferably should extend vertically independent of the inclination of the slope for optimizing the stabilizing effect on the occurrence of heavy rain showers.

According to the invention the above requirements are met in connection with a device of the type mentioned above, which is characterized in that the web is constituted by an initially relatively thin, substantially plane web, preferably made of bendable plastic, which in one direction is provided with rows of subsequently arranged slits which are so staggered relative to each other that the web, when being stretched transversely relative to the slits, forms oppositely undulated strips which through a suitable mounting define side by side arranged cells or pockets. By spreading the transversely stretched device on a slope, the cells or pockets can be filled with soil or moldable composition which is to be stabilized by the device.

In other words, a flat web is taken as a basis for the present device, said web being provided with the above-stated slits, and allowing for production in larger or lesser sheets for storage and transport. Thus, the web can be transported to the place of use in stacks of sheets rendering a minimum transport volume. Only at the site, i.e., after the web has been spread out on the ground and has been stretched in the direction transversely to the slits, will there be formed upwardly extending backs or walls, which in turn form pockets which stabilize the soil or other moldable composition, which after the usage is filled into the pockets of the device. The web can then in advance have been cut in appropriate lengths depending on the landscape or the ground which is to be prepared for stabilizing.

During the mounting of the device, it is not subjected to any permanent deformation, since the soil masses or other material which are filled into the pockets will keep the web in position in "stretched" condition.

Another special feature of the present device is related to the small thickness of the web, the stretching thereof implying that sharp lower edges appear along the undulating strips, and said sharp edges can easily be pressed into the ground when mounting the web on the site, a fact which entails a secure anchoring of the device even in steep slopes.

A further advantageous feature of especially preferred embodiments of the device of the invention is the fact that by various degrees of stretching there can be achieved various mutual angles between the wall portions of the undulated strips, and that various degrees of stretching can be used for various slope angles of the ground which is to carry the device. Various degrees of stretching will also give different sizes of the cells or pockets, giving larger possibility of selecting a device structure depending on the shape of the terrain.

Alternatively, the device may be placed on a support and serve as a guard for sand, snow or similar material.

In the area of each slit there may be provided an edge area taking the form of bulging or embossment, which in connection with the stretching will ensure that the undulation of the corresponding strip portions takes place in the right direction relative to other strip portions.

To achieve a correct direction of the undulation of the strips during mounting of the device according to the invention, the plastic web may, during the production thereof, be subjected to an initial stretching transversely to the slits. This initial stretching may be effected so far that the individual strip portions have embedded thereinto a permanent initial plastic deformation which is to point out the direction in which the strip portions are to undulate during the final and complete stretch of the web on site. The initial stretching may be affected in the area of the slits, for example by means of combined slitting and pressing rollers.

This small prestretching will give some bulging of the strip portions, especially in the area of the slits, but the flexible web will still be substantially flat and can be stacked as sheets where the already stretched slits of one sheet will fit into the slits of the sheet staggered below.

The slits may at each end be provided with curved portions for resisting breakage when the web is stretched.

Further, the web may be laminated with a suitable woven or knitted cloth, especially for reinforcing the end portions of the slits.

Preferably the web is manufactured from plastic, for example polyethylene. Suitable additives to the plastic may vary the resistance against decomposition.

Other objects, advantages and novel features of the present invention will become apparent from the following detailed description of the invention when considered in conjunction with the accompanying drawings.

DETAILED DESCRIPTION OF THE DRAWINGS

Figure 1:
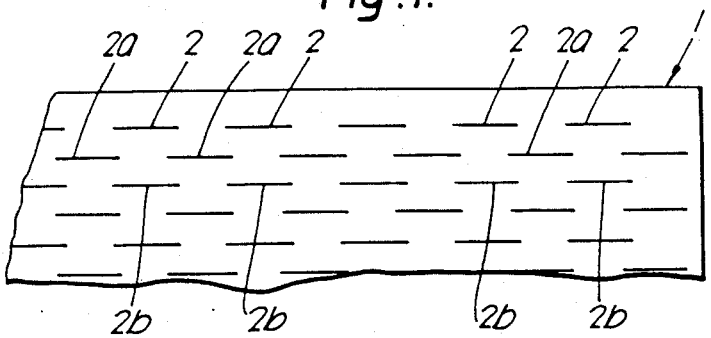
FIG. 1 is a schematic plan view of a web constructed in accordance with a preferred embodiment of a device constructed is accordance with the present invention.

In FIG. 1, which illustrates schematically a top view of a web which forms the basis of an embodiment of a device according to the invention used as a soil stabilizing device, the web itself is designated by reference numeral 1. The web is appropriately manufactured through an extrusion or calendar process for forming a plastic material to a web having a thickness from for example 0.1 to 6 mm. The thin substantially plane web 1 of preferably flexible plastic material is provided with rows of consecutively arranged slits during the manufacturing, for example by punching or slitting. The slits 2 in the first row are arranged substantially with even spacing, whereas the slits 2*a* of the adjacent row are arranged with the same spacing but staggered relative to the slits 2 of the first row. The next row of slits 2*b* are provided parallel to the slits 2 of the first row, and there is in this way provided a slit pattern which by an appropriate stretching of the web 1 creates oppositely undulating strips 3*a*, 3*b*, 3*c*, etc., as this is especially apparent from FIG. 2*a*.

Figures 1A, 1B, 2A, 2B:
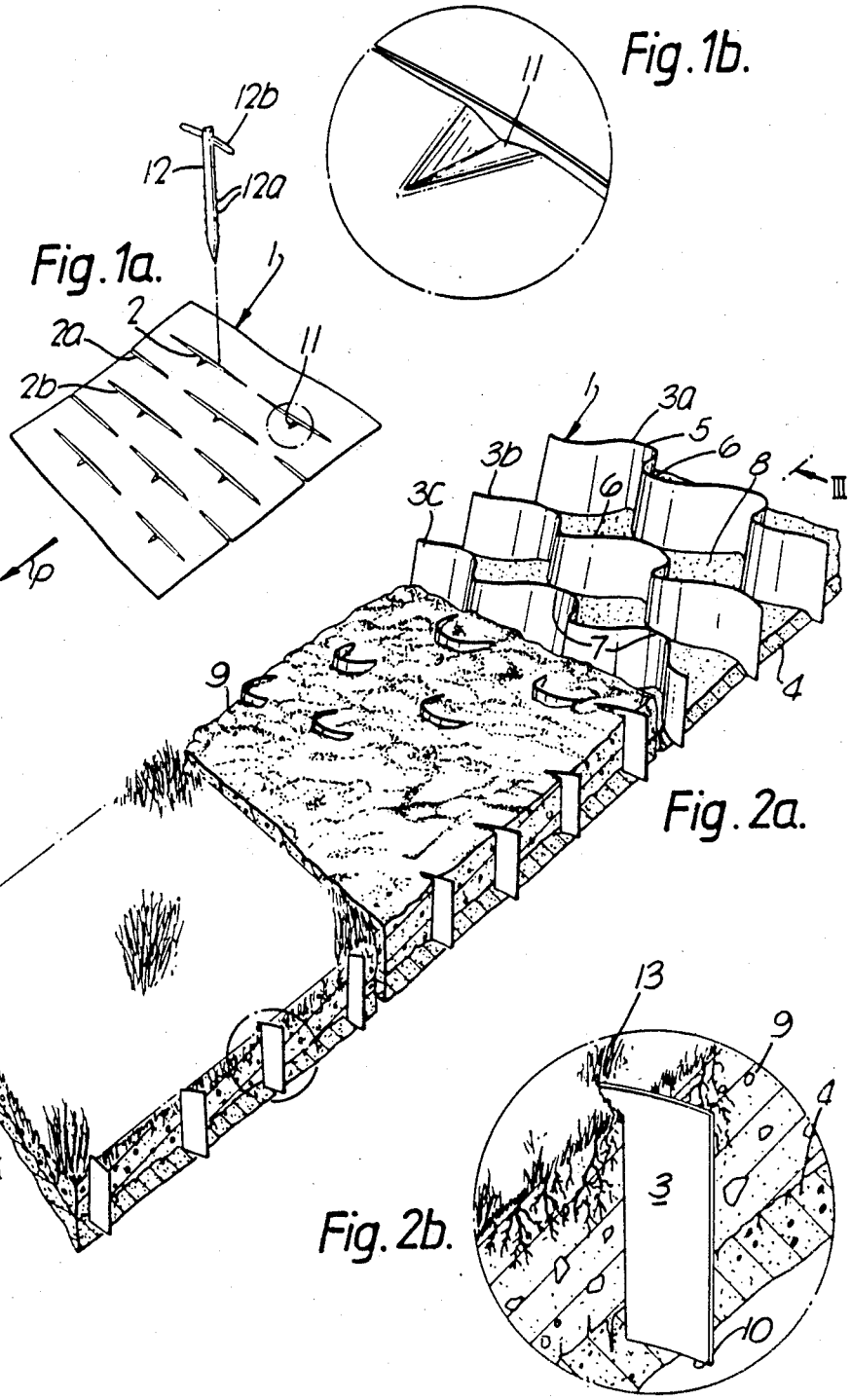
FIG. 1*a* is a is an enlarged view of a section of a web constructed according to the preferred embodiment of the invention of FIG. 1.
FIG. 1*b* is an enlarged fraction of an area of the device according to FIG. 1*a;*
FIG. 2*a* is a perspective view illustrating the various phases of the stabilizing process in which the device according to the invention is to be used, the upper part of the Figure illustrating the device in mounted position, the center portion of the figure illustrating the device covered with soil material, and the lower portion of the figure illustrating the stabilized area after a growing season.
FIG. 2*b* is an enlarged fraction of the area indicated in FIG. 2*a;*
Figure 5:
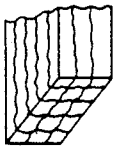
FIG. 5 is a schematic showing of a plastic laminate material with reinforcement by woven or knitted cloth.
Figure 6:
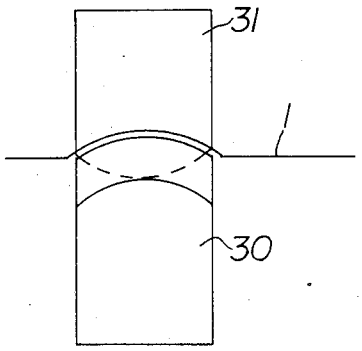
FIGS. 6 and 7 schematically show the cutting blades forming the slits in the web from a front and side view, respectively.
Figure 7:
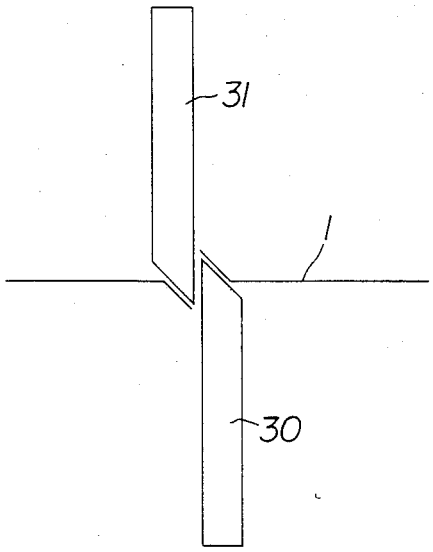

The plastic web which in FIG. 1 is designated by 1, is slit or punched during the manufacturing thereof so as to comprise a plurality of rows of slits 2, 2*a*, 2*b*, etc., the number of rows being chosen according to the field of application of the finished manufactured web. FIGS. 6 and 7 show curved knife blades 30 and 31 which slit the web 1 to form the slits 2, 2*a*, etc. Thus, the web can be manufactured in desired width and can be delivered as web-shaped plates (sheets). In FIG. 1*a* there is shown a section of a web 1 which has been rolled or spread out on a support onto which the soil masses are to be stabilized. The slits are made transverse to the production line direction of the web; and the web is placed down the slope in the longitudinal direction, and also stretched in this direction.

When the plastic foil or plastic web 1 has been spread out on a support, for example a sloping ground 4, as this appears from FIG. 2*a*, there will by appropriate stretching of the web 1 as symbolized by the arrow P in FIG. 1*a*, oppositely undulating strips 3*a*, 3*b*, 3*c* will be formed. These strips will have alternating concave and convex portions 5 and 6, respectively, as a result of the slits 2, 2*a*, 2*b*, whereas at the interconnected web zones retained between the slits, here the zones 7, will have a relatively straight form. In other words, side by side arranged or stage-shaped cells or pockets 8 are provided which can be filled with soil which is stabilized by the device 1.

At the top of FIG. 2*a* there is shown sections of a web 1 which have been stretched transversely to the slits, and which have been placed on a sloping ground 4, for example of soil or gravel. In the middle of FIG. 2*a* it is shown how the cells or the pockets 8 have been filled with soil 9 which is stabilized by the device 1. The stretching (illustrated in FIG. 1*a*) gives the web 1 a substantially non-permanent deformation which however will be retained by the filling of soil mass 9. The upwardly extending backs or walls of the undulations 3*a*, 3*b*, 3*c* not only form pockets 8 but also render a favorable anchoring due to the sharp lower edges 10 permit which burying of themselves fairly well into the ground, as this is especially illustrated in FIG. 2*b*.

Figure 3:
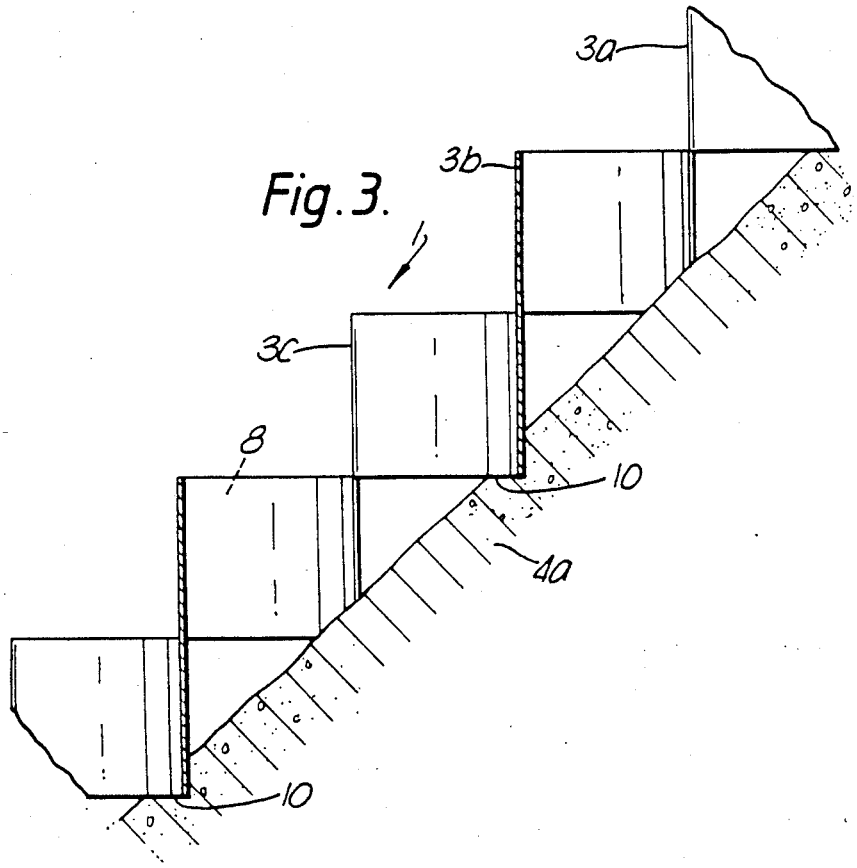
FIG. 3 illustrates on a larger scale a fraction of a section through the device according to FIG. 2*a* as seen in the direction III—III in FIG. 2*a;*

Because the web 1 in its stretched condition can be pressed deeply into the ground, it will not slide even in steep slopes. This condition is even better illustrated in FIG. 3, in which the device 1 is pressed down into an especially steep hill 4*a*, and in which the walls of the undulations 3*a*, 3*b*, 3*c* will still extend vertically from the ground for the forming of cells or pockets 8 having vertical backs or walls. This vertical arrangement of the backs or the walls will, aside from rendering a favorable anchoring, also give an especially good stabilization of the soil 9 and the pockets during heavy rain.

As appearing from FIG. 1*b* there may be arranged a bulge or embossing 11 in the area of each slit 2, 2*a*, 2*b*, etc., which during the stretching of the web 1 will aid in that the corresponding strip portion will undulate in the correct direction relative to other strip portions.

An alternative way to have the individual strip portion undulate in the correct direction during the stretching of the web on site, is to provide that the plastic web is subjected to an introductory stretching in the area of the slits, as this is further disclosed in the preamble of this specification.

In FIG. 1*a* there is also illustrated a fixing peg 12 which during the spreading of the web 1 on a sloping ground 4, is inserted through a slit 2 below the upper strip 3*a*, the peg 12 at its lower end being provided with barbs 12*a* serving for the attachment to the ground, and which at its upper portion is provided with arms 12*b* for supporting the upper strip 2 when the web 1 is stretched out as illustrated in FIG. 2*a*.

At the bottom of FIG. 2*a* it is shown how the landscape, in which is utilized the soil stabilizing device according to the invention, can appear after a growth season, the top of the soil 9 now being overgrown by a lawn 13 having its roots extending down into the soil 9.

It is to be understood that in the openings or the pockets 8 in the web 1 there can also be planted bushes or the like, all in dependence of the landscape which is to be shaped by means of the soil stabilizing device.

The material from which the web 1 is to be manufactured, can for example be a plastic material filled with carbon black, a factor which renders the plastic very resistant to decomposition. In certain preferred embodiments the plastics are manufactured without any fillers or are mixed with pigments making the web chemically unstable, a factor which ensures that the plastics will disappear after some years out in nature.

If there is used a thicker plastic web as a soil stabilizing device it may be necessary to use mechanical power for the stretching thereof. This may in some cases be necessary, but the web is preferably manufactured as a flexible plastic web which can be stretched on site by means of manual force.

In certain preferred embodiments with thicker plastic webs, heat treatment is used, such that the plastic in stretched condition will retain its stretched configuration, and the web could then be used for heavier stabilizing objectives, for example stabilizing temporary roads or areas, military airports or the like.

Alternatively, the present device can be mounted on a support to serve as a guard for sand, snow or the like.

In this connection it may be appropriate to use a somewhat thicker web which is stretched on a rack or rail or between poles which are located along a railway or a road being especially exposed for the accumulation of whirling snow or sand. By means of the present device the snow or sand particles could be guided so as to be collected in snowdrifts or sandheaps where they are apt to make the least damage, respectively are causing the least inconvenience.

It is also to be understood that the device for stabilizing masses, described herein as especially for soil masses, can be filled with other material than earth or soil masses. In connection with for example steep riverbanks, etc., which are covered with concrete or similar curing materials, the device according to the invention can be mounted on the ground to be stabilized. Thereafter the pockets of the device are filled with non-cured concrete or the like which is supported by the pockets 8 formed by the present web 1. Thus, the mounted web will facilitate the spreading of the material to be cured and allow for an even distribution thereof due to the pocket configuration of the web.

Figure 4:
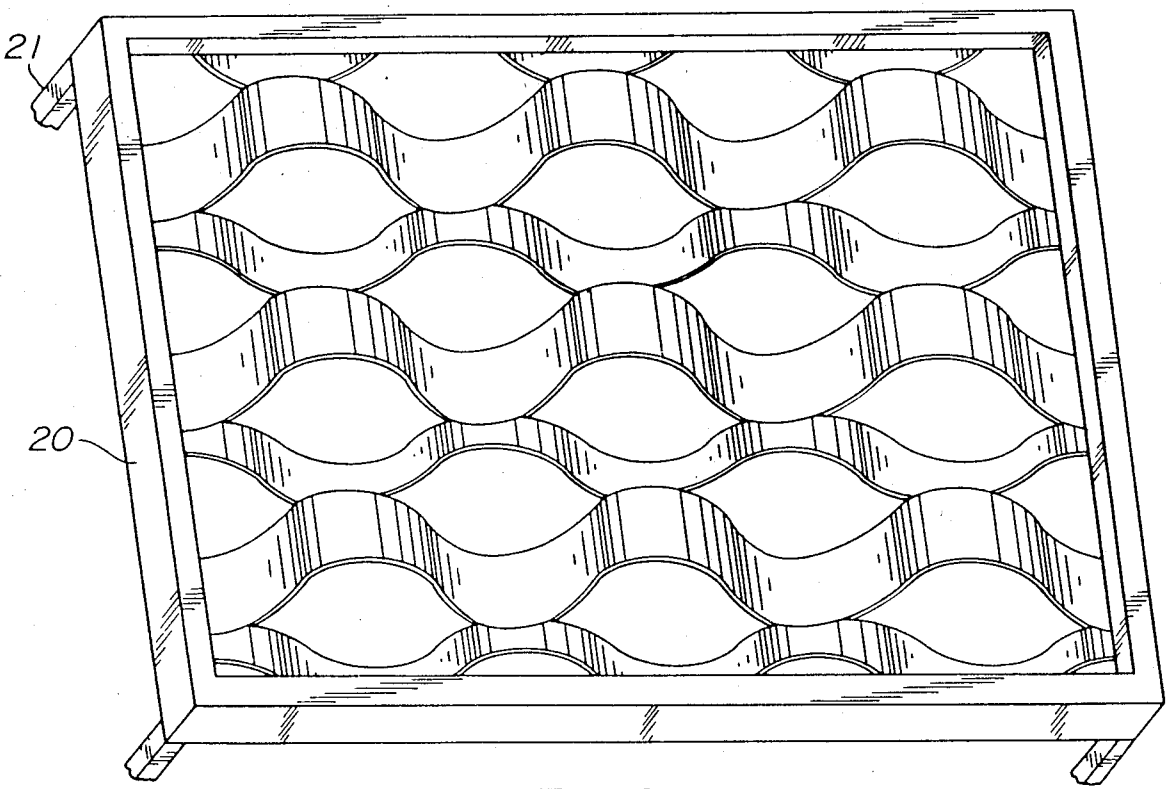
FIG. 4 illustrates the device used on an awning or a guard against sand or snow.

It is to be understood that the device according to the invention also can be used in awnings, for example for protection against sunshine, light radiation, etc., according to certain contemplated embodiments, such as is shown in FIG. 4, wherein a frame structure 20 is placed above the ground on posts 21.

For such purposes the device can be formed of materials of various quality, color, translucence, etc. The device can then be premounted on a frame which can be mounted in position on the site where it is to be used.

In especially preferred embodiments for use with soil, uncured cement and the like, the slits 2, 2*a*, and 2*b* are between 150 and 300 mm long in the direction transverse to the direction P. The spacing of the slits in the direction P are preferably between 30 and 150 mm. With these dimensional ranges, the pockets formed when installed have an approximate diameter of 95–190 mm with a height of 30 to 150 mm. For preferred embodiments to be used as awnings and the like, the length of the slits in the spacing will vary according to the particular desired shading effects. For the use of preferred embodiments as guards for sand, snow and the like, the length and spacing will vary according to the specific conditions to be met.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed:

1. A device, especially for stabilizing bulk material to a support surface, wherein an initially relative thin, substantially flat web having a top side and a bottom side and in a first direction is provided with rows of consecutively arranged slit means extending between said sides; said rows of slit means are staggered relative to each other in said first direction so that the web by stretching in a second direction which is angled to said first direction, forms oppositely undulating strips which in turn define rows of side by side arranged cells or pockets between a top side portion of the web adjacent one side of the slit means with a bottom side portion of the web adjacent another side of the slit means; and wherein the cells or pockets in one row are offset in said first direction from the cells or pockets in an adjacent row; and further wherein the web has an introductory stretching which is effected during the production of the web which will initiate the direction in which the strips are to undulate during the final stretching.

2. Device as claimed in claim 1, especially for stabilizing soil material, on the ground wherein the flat web is stretchingly placed on a relatively steep ground to define side by side arranged cells or pockets which can be filled with soil which is stabilized by the cells or pockets in the web.

3. Device as claimed in claim 1, wherein a portion means of the slit means adjacent one side of the slit means can easily be pressed down into a support surface to thereby ensure anchoring of the device to the support surface.

4. Device as claimed in claim 1, wherein various degrees of stretching of the web renders various mutual angles between the side portions of the undulating strips to provide different configurations of the cells or pockets and wherein the various degrees of stretching is used in dependence of the sloping angle of the support surface.

5. Device as claimed in claim 1, wherein the stretched flat web is positioned on a rack to serve as a guard for sand, snow or similar material.

6. Device as claimed in claim 1, wherein in the area of one or more slit means there is provided a bulge or embossing which during the final stretching of the web serve for the undulating of the corresponding strip portion relative to the other strip portions.

7. Device as claimed in claim 1, wherein the initial stretching is effected in the area of the slit means by means of combined slitting and pressing rollers.

8. Device as claimed in claim 1, wherein at ends of the slit means of the web there are provided curved portions to resist breakage when the web is stretched transversely relative to the direction of the slit means.

9. Device as claimed in claim 1, wherein the stretched direction is substantially at right angles to the first direction.

10. Device as claimed in claim 1, wherein said web sheet is appropriately positioned on a rack to serve as a guard for sand, snow or the like.

11. Device as claimed in claim 1, wherein the web is laminated with a suitable woven or knitted cloth for further reinforcement of the end portions of the slits.

12. The use of a device as claimed in claim 1 as an awning, for example for protection against any of sunshine, light and, radiation.

13. A method for stabilizing bulk material, especially soil masses and other molded compositions such as uncured concrete, wherein a suitable length of a relatively thin substantially flat web of flexible material having a top side and a bottom side and in a first direction is provided with rows of consecutively arranged slit means extending between both side and in a first direction is provided with rows of consecutively arranged slit means extending between said sides, is spread out on a flat or sloping ground which is to be soil stabilized; the web at one longitudinally extending edge thereof being first attached to the ground by means of appropriate fixing means and thereafter stretched in a second direction, which is angled to said first direction, for the forming of oppositely undulating strips, which in turn define rows of side by side arranged cells or pockets between a top side portion of the web adjacent one side of the slit means with a bottom side portion of the web adjacent another side of the slit means; and wherein the cells or pockets in one row are offset in said first direction from the cells or pockets in an adjacent row; and then filling said cells or pockets with soil which is stabilized and further wherein the web has an introductory stretching which is effected during the production of the web and which will initiate the direction in which the strips are to undulate during the final stretching.

14. Method as claimed in claim 13, wherein the web, after the stretching, will have a lower edge portion of the slit means pressed into the ground for anchoring of the device in the ground.

15. Method as claimed in claim 13, wherein the web, at the site of use, is stretched in a second direction for through non-permanent deformation to define said cells or pockets and wherein the deformation is retained by the filling of soil in said cells or pockets.

16. The method of claim 13, wherein the stretched direction is substantially at right angles to the first direction.

17. Method for stabilizing bulk material, wherein a relatively thin, substantially flat web of flexible material, in a first direction, is firstly provided with a plurality of rows of slits with the slits in one row being offset in said first direction with the slits in an adjacent row; secondly the web in a suitable length is attached to a rack along one of its end edges; and thirdly, the web is thereafter stretched in a direction, which is angled to said first direction, for the forming of oppositely undulating strips which in turn define side by side arranged cells or pockets serving to guard against whirling sand, snow or similar material; and further wherein the web has an introductory stretching which is effected during the production of the web and which will initiate the direction in which the strips are to undulate during the final stretching.

18. The method of claim 17, wherein the stretched direction is substantially at right angles to the first direction.

* * * * *